United States Patent [19]

Ventrella

[11] Patent Number: 4,480,418

[45] Date of Patent: Nov. 6, 1984

[54] MODULAR SYSTEM FOR SPACE GRID STRUCTURES

[76] Inventor: Ettore Ventrella, Corso Garibaldi 333, 80139 Napoli, Italy

[21] Appl. No.: 362,971

[22] Filed: Mar. 29, 1982

[30] Foreign Application Priority Data

Jul. 14, 1981 [EP] European Pat. Off. ..... 81830116.0

[51] Int. Cl.[3] ..... E04H 12/00

[52] U.S. Cl. ..... 52/648; 403/64; 403/171; 403/176

[58] Field of Search ..... 52/648, 650, 81, 86; 403/64, 171, 172, 176, 174, 178

[56] References Cited

U.S. PATENT DOCUMENTS

| | | | |
|---|---|---|---|
| 1,946,408 | 2/1934 | Loudy | 403/64 |
| 2,195,336 | 3/1940 | Loop | 403/64 |
| 2,683,329 | 7/1954 | Kobler | 403/171 |
| 3,747,261 | 7/1973 | Salem | 403/176 |
| 3,982,841 | 9/1976 | Endzweig | 403/171 |
| 4,129,975 | 12/1978 | Gabriel | 403/171 |
| 4,322,176 | 3/1982 | Johnson | 403/176 |
| 4,324,083 | 4/1982 | Johnson | 403/172 |
| 4,353,662 | 10/1982 | Du Chateau | 403/171 |

FOREIGN PATENT DOCUMENTS

| | | | |
|---|---|---|---|
| 1391973 | 2/1965 | France | 403/171 |
| 50706 | 6/1933 | Netherlands | 403/171 |

*Primary Examiner*—Henry E. Raduazo
*Attorney, Agent, or Firm*—James & Franklin

[57] ABSTRACT

The ends of cylindrical girders are provided with spherical members mounted thereto. Sets of twelve, eight or four girders can be connected by a single joint, depending upon the configuration thereof. Each joint includes first and second parts which assemble, by means of a single bolt, to form a structure within which the spherical girder end members are received. The joint parts are provided with openings through which the girders extend. Some of the openings are elongated so that the position of the girders extending therethrough can be varied relative to the joint. The joint parts may be provided with external structural rigidity enhancement members.

5 Claims, 27 Drawing Figures

Section CC'

Section BB'

Section AA'

Section fig.7

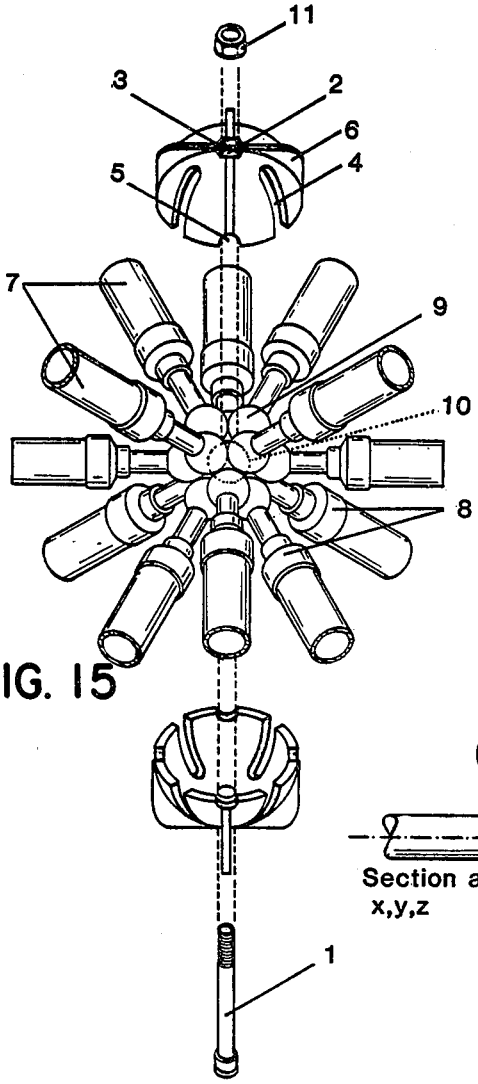
FIG. 15
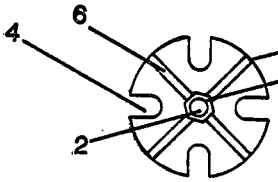
FIG. 16
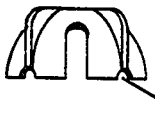
FIG. 17
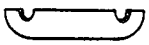
FIG. 18
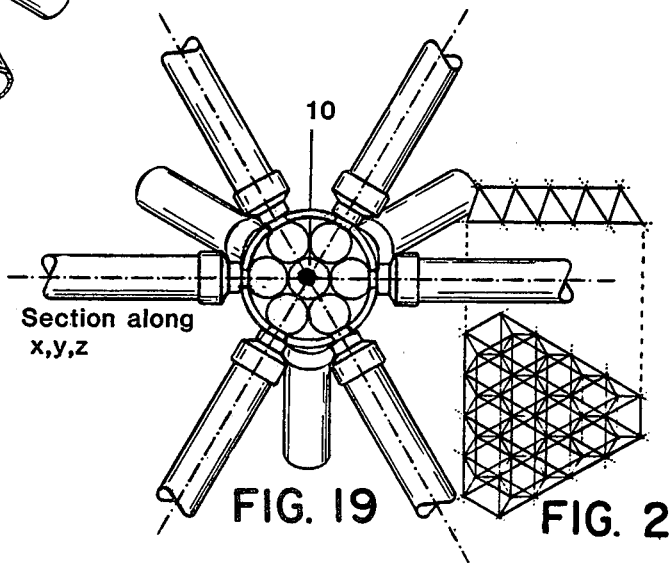
FIG. 19
FIG. 20

MODULAR SYSTEM FOR SPACE GRID STRUCTURES

The present invention relates to space grid structures and, more particularly, to a modular system designed for use in the fabrication of space grid structures which are composed of joints and girders of simple structure which are easily assembled and provide maximum flexibility in design.

Space grid structures have long been used in architectural and engineering projects. The design of the basic components employed in such structures has been known in a variety of forms. Regardless of the form, the basic components of the structures share one common principle—ease of repetition of a basic geometric design. Thus, the basic module, whatever its geometry, is used repeatedly in space, simply by adding more joints and girders, depending upon the requirements of the particular design.

For example, the German "MERO" and the American "UNISTRUT" systems are two well known systems of this type. These and other systems of this type are all based on the principle that the joint is, from the point of view of statics, a fixed joint. All of the girders are rigidly fixed at a particular angle relative to a joint. This principle restricts the possible number of geometrical patterns which can be obtained.

Another disadvantage of this type of system is that every girder must be individually fixed to the joint. This normally requires some elevated assembly stages, a great disadvantage for large systems composed of thousands of girders and joints.

The present invention is designed to overcome the above-mentioned disadvantages. The invention resolves the problem of the fixed joint by forming the joint which acts like a hinge. Some of the girders attached to a joint can be moved relative to the joint so that the girder can be situated in a great number of different positions relative to the joint. Thus, one significant advantage achieved by the present invention is that the structure of the joint results in a system which can generate all of the geometric configurations normally associated with known structures and, in addition, other forms, either curves or planes, which are not possible to achieve with known structures.

Another significant advantage of the present system is that assembly is greatly simplified. Only a single bolt is required to assemble a joint which may connect up to twelve girders, depending upon the structure of the joint. This permits one to reduce, to a minimum, the assembly stages required.

In accordance with the present invention, a modular system for a space grid structure is provided. The system includes a plurality of girders and a joint. Each of the girders includes a substantially spherical member mounted to one end of the girder. The joint comprises first and second parts and a means for fastening the parts together to form an assembly. The spherical end members are received within the assembly. The assembly is provided with openings through which the girders extend. At least one of these openings is elongated. The position of the girder extending through the elongated opening can be varied relative to the assembly by moving the girder along the elongated opening.

The girders are preferably cylindrically shaped. Elongated parts are provided to connect the ends of the girders to the spherical members. The connecting parts are also preferably cylindrically shaped. The diameter of the connecting part is smaller than the diameter of the girder. It is the connecting part which extends through the joint opening. Thus, the size of the opening is chosen in accordance with the diameter of the connecting part.

Some of the openings in the joint assembly are circular and have a diameter approximately equal to the diameter of the connecting part. These circular openings are preferably orthogonally placed around the joint assembly and are adapted to receive the horizontal girders. Due to the shape of these openings, no movement of the girders received therein, with respect to the joint assembly, is possible.

Preferably, the joint assembly further comprises a structural rigidity enhancing member. This rigidity enhancing member increases the strength of the joint assembly and is preferably mounted on the exterior thereof.

The fastening means is preferably a single bolt. The bolt passes through both of the joint parts with the enlarged head thereof located on the exterior of one joint part, and an externally threaded part extending through the other joint part, such that a nut may be affixed thereto.

One of the joint parts is preferably substantially hemispherically shaped. In some cases, both of the joint parts are preferably substantially hemispherically shaped.

In some cases, the interior of the joint assembly within which the spherical girder end members are received, may be hollow. In other cases, recesses are provided in the interior of the joint assembly, aligned with the openings. These recesses are adapted to receive the individual spherical members therein.

In some cases, the elongated openings are provided with an enlarged portion at the end thereof. This enlarged portion preferably is elongated in a direction which is substantially perpendicular to the direction of elongation of the body of the opening.

In some cases, an unattached, substantially spherical member is received at the center of the joint assembly between the spherical members.

To these objects and to those such other objects which may hereinafter appear, the present invention relates to a modular system for a space grid structure, as described in detail in the following specification, and recited in the annexed claims, taken together with the accompanying drawings, wherein like numerals refer to like parts and in which:

FIGS. 1, 2, 3 and 20, respectively, illustrate examples of different geometric patterns which can be achieved with the system of the present invention;

FIGS. 4, 5 and 6, respectively, represent plan views of different embodiments of the joint of the present invention, all of which are designed for use with twelve girders;

FIGS. 8, 10, 11, respectively, are cross-sectional views of each of the embodiments illustrated in FIGS. 4, 5 and 6;

FIGS. 7 and 12, respectively, represent plan and section views of an embodiment of a joint of the present invention, designed for use with eight girders;

FIG. 9 is a sectional view of a joint of the present invention designed for use with four girders;

FIGS. 13 and 14, respectively, illustrate two different ways of affixing a spherical member to the end of a girder;

FIG. 15 is a partially exploded view of the joint configuration shown in FIGS. 4 and 8, illustrating the interior of the joint;

FIGS. 16 and 17 are, respectively, plan and side views of a hemispherical joint member;

FIG. 18 is a side view of a joint member designed for use with eight convergent girders;

FIG. 19 is a cross-sectional view of the joint illustrated in FIG. 15; and

The drawings illustrate a modular system for use in fabricating space grid structures such as those shown in FIGS. 1, 2, 3 and 20. The system comprises joints of various configurations designed to connect twelve, eight or four cylindrical girders. The girders may be connected to the joint either obliquely or horizontally. As best seen in FIG. 15, each joint is composed of two parts which, when assembled, form a plurality of elongated openings 4 and circular openings 5, through which the obliquely positioned and horizontally positioned girders, respectively, extend.

Figure 1:
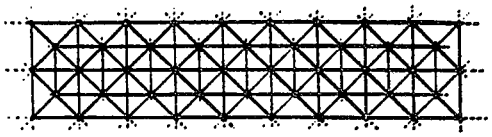
Figure 2:
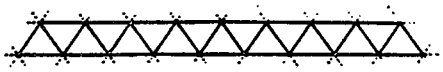
Figure 3:
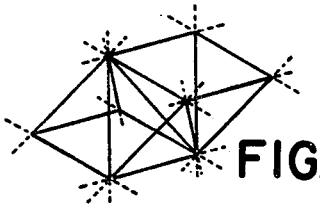
Figure 4:
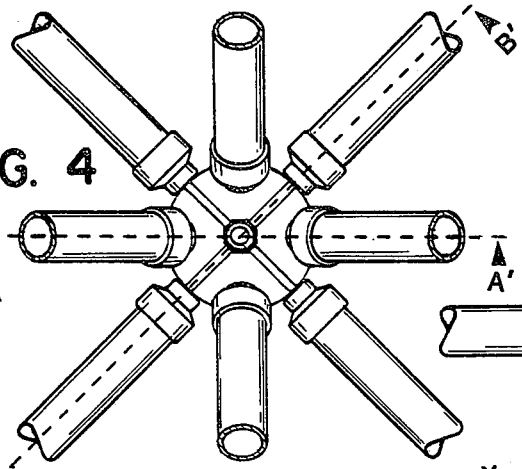
Figure 5:
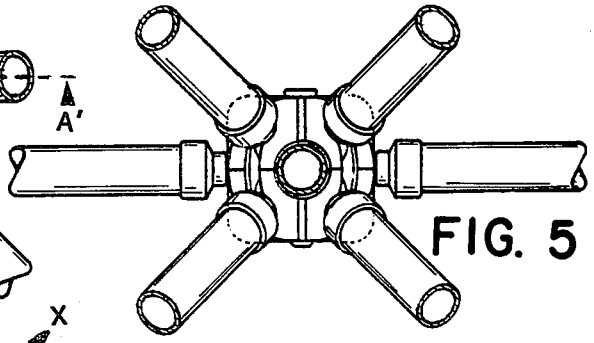
Figure 6:
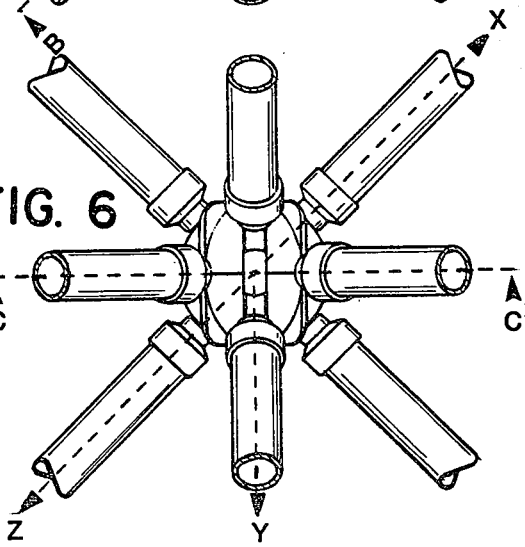
Figure 7:
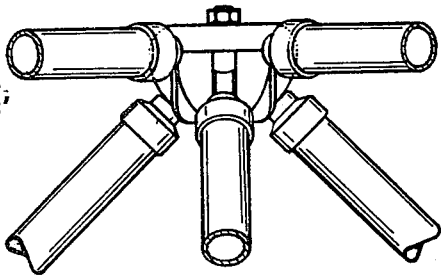
Figure 8:
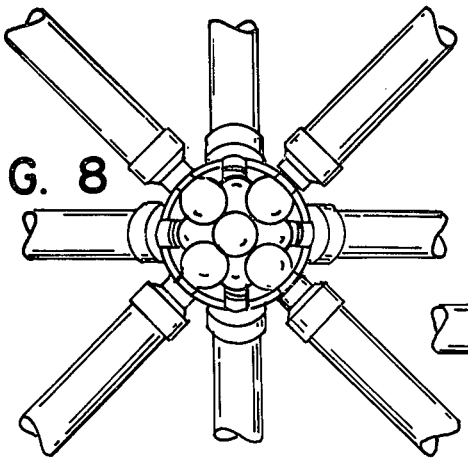
Figure 9:
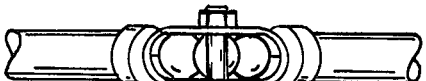
Figure 10:
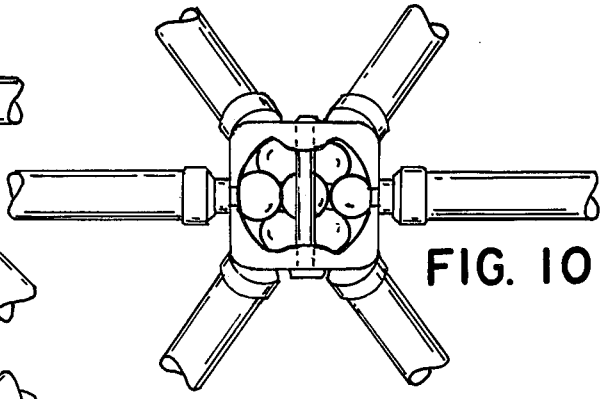
Figure 11:
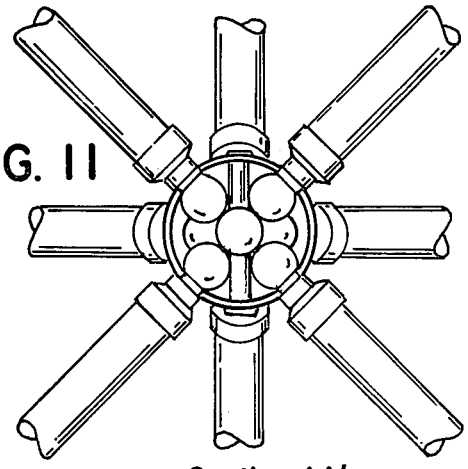
Figure 12:
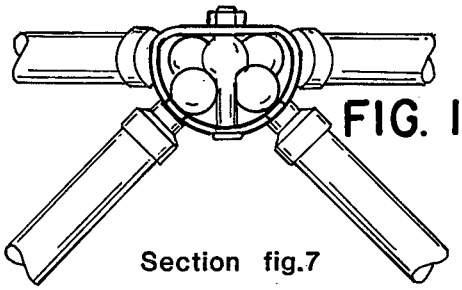
Figure 13:
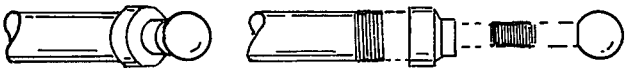
Figure 14:
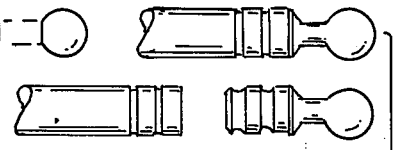

Elongated cylindrical connecting parts are provided to mount spherical members 9 to the ends of the girders, as seen in FIGS. 13 and 14. It is the connecting parts which extend through the openings in the joint assembly, with the spherical members situated within the assembly and the girder itself positioned at the exterior of the assembly. The diameter of the connecting part is smaller than that of the girder. The diameter of the circular openings 5 is substantially equal to that of the connecting part, such that the position of the horizontal girders is fixed relative to the joint. The elongated openings 4 have a width substantially equal to the diameter of the connecting part, but the length thereof is substantially larger to permit the girder to be positioned with respect to the joint in a large number of different oblique positions.

The spherical girder end members 9 converge toward the hollow center of the joint around to a central unattached spherical member 10. The spherical shape of the end members 9 and unattached member 10 facilitates the relative positioning of the oblique girders with respect to each other and the joint.

The joint parts are fastened together by a single bolt 1 and a nut 11. The bolt passes through both parts. Recesses are provided in the exterior surface of each joint part to receive the nut and enlarged head of the bolt, respectively. Elongated openings 4 are provided with an inclined or beveled edge 12 to facilitate movement of the oblique girders relative to the joint.

The joint parts are preferably provided with external structural rigidity enhancing members 6. Members 6 balance the forces applied to the joint and enhance the strength thereof.

In one form, to permit the introduction of a bolt of bigger diameter, the unattached spherical member 10 is eliminated (FIGS. 21 and 22) and the holes in the joint parts are enlarged according to the diameter of the bolt. In this case, the configuration of the interior of the joint part may be altered. Instead of a hollow interior, substantially spherical recesses 14 are provided to receive the individual girder spherical end members. These recesses permit positioning of the girders in a circular pattern.

It is not necessary to always use joint parts of equal shape and/or size. Different configurations may be used for different applications (planar, grids, curved, etc.), as illustrated in the drawings.

Figure 21:
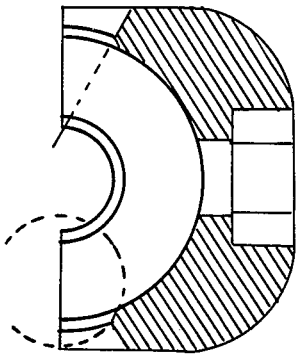
FIGS. 21 and 22 illustrate a joint configuration wherein the central unattached spherical member is eliminated in order to permit the introduction of a larger bolt.
Figure 21:
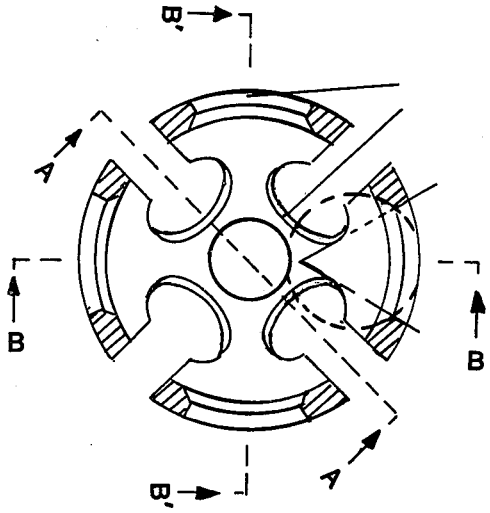
Figure 21A:
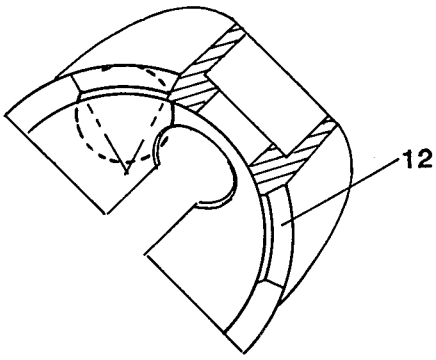
Figure 21B:
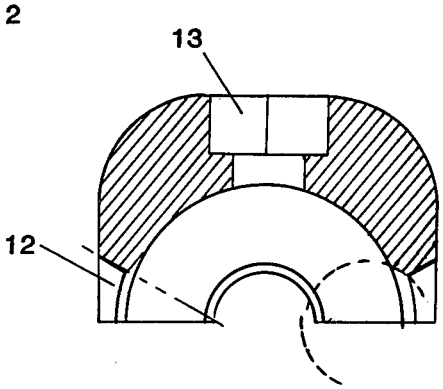
Figure 22A:
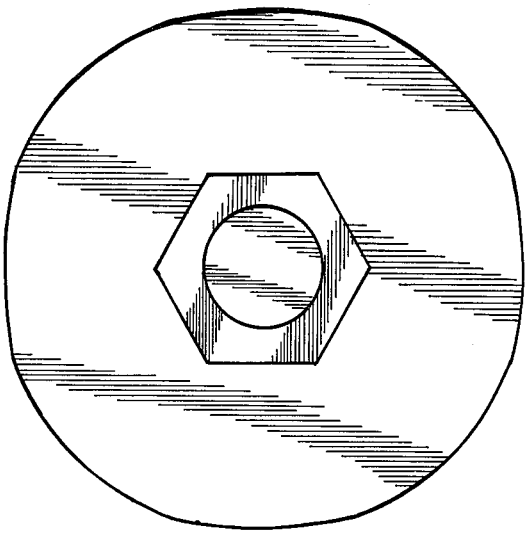
Figure 22C:
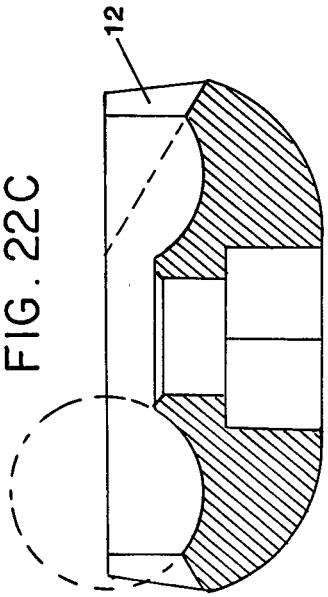
Figure 22B:
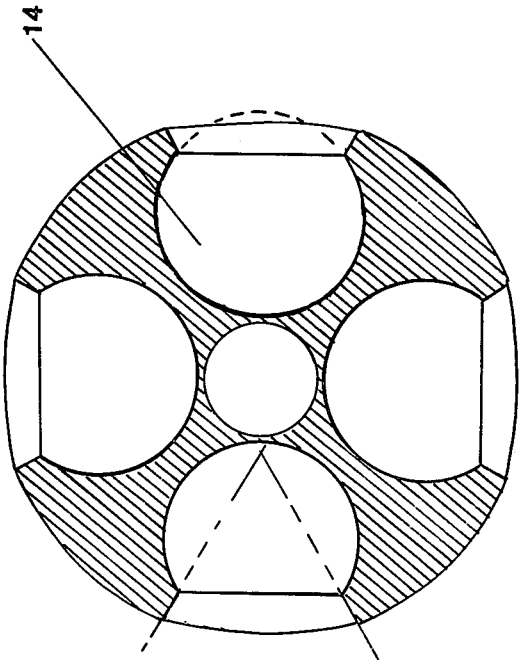

As seen in FIG. 21, the elongated openings may be provided with enlarged end portions. The end portions extend in a direction generally perpendicular to the body of the opening. The enlarged end portions provide an enhanced degree of flexibility by permitting a greater variation in the positioning of the oblique girders.

While only a limited number of embodiments of the present invention have been disclosed herein for purposes of illustration, it is obvious that many modifications and variations could be made thereto. It is intended to cover all of these variations and modifications which fall within the scope of the present invention, as defined by the following claims:

I claim:

1. A modular system for use in fabricating space grid structures comprising a plurality of girders and a joint, each of said girders comprising a substantially spherical member fixedly mounted to an end thereof by a substantially cylindrical connecting portion of a given diameter, said joint comprising first and second substantially hemispherical hollow parts being adapted to be assembled to define a cavity into which one or more of said end members are substantially completely received, each of said parts having four substantially orthogonal substantially semi-circular openings and four substantially orthogonal elongated openings, said parts, when assembled, forming four substantially orthogonal substantially circular openings, each having a diameter substantially equal to said diameter and four substantially orthogonal elongated openings, each having a width substantially equal to said diameter and extending in a direction substantially parallel to the axis of said joint, said openings being adapted to accept said connecting portions therein, means extending through said cavity for connecting said part, said connecting means extending along said axis of said joint and structural rigidity enhancing members extending outwardly from said parts in a direction substantially coplanar with said axis.

2. The system of claim 1, wherein said parts define a single cavity and a plurality of said end members are received within said single cavity.

3. The system of claim 1, wherein each of said end members is in physical contact with adjacent ones of said end members.

4. The system of claim 1, wherein all of said end members abut said connecting means.

5. The system of claim 1, wherein both of said joint parts are substantially hemispherical.

* * * * *